US006086391A

United States Patent [19]

Chiu

[11] Patent Number: 6,086,391

[45] Date of Patent: Jul. 11, 2000

[54] SAFETY SOCKET HEAD

[75] Inventor: Shun Kuo Chiu, Kaohsiung, Taiwan

[73] Assignee: Tzu Ying Ho, Kaohsiung Hsien, Taiwan

[21] Appl. No.: 09/066,830

[22] Filed: Apr. 27, 1998

Related U.S. Application Data

[60] Provisional application No. 60/080,394, Apr. 2, 1998.

[51] Int. Cl.[7] ..... H01R 13/44

[52] U.S. Cl. ..... 439/145

[58] Field of Search ..... 439/137, 136, 439/93, 145, 113, 114

[56] References Cited

U.S. PATENT DOCUMENTS

| | | | |
|---|---|---|---|
| 4,729,741 | 3/1988 | Peng | 439/137 |
| 5,011,419 | 4/1991 | Mann | 439/145 |
| 5,069,630 | 12/1991 | Tseng et al. | 439/137 |
| 5,391,085 | 2/1995 | Tigner | 439/137 |
| 5,702,259 | 12/1997 | Lee | 439/137 |

*Primary Examiner*—Lincoln Donovan
*Assistant Examiner*—Chandrika Prasad
*Attorney, Agent, or Firm*—Raymond Y. Chan; David and Raymond

[57] ABSTRACT

A safety socket head includes a socket housing which has a first socket slot and a second socket slot parallelly provided thereon, a first shelter which is slidably supported inside the socket housing and positioned below the first socket slot for blocking the first socket slot during a normal condition, a second shelter which is slidably supported inside the socket housing and positioned below the second socket slot for blocking the second socket slot during the normal condition, and a resilient element for retaining the first shelter and the second shelter in the normal condition so as to shelter any undesired substance to intrude into either the first socket slot or the second socket slot. However, when the two plug plates of an electrical plug are inserted into the first and second socket slots simultaneously, the two plug plates drive both the first shelter and the second shelter to slide aside respectively to enable the two plug plates to insert therethrough into the socket body. Moreover, when the two plug plates are detached from the safety socket head, the resilient element inside the socket housing respectively push the first shelter and the second shelter to slide back to the normal condition.

13 Claims, 7 Drawing Sheets

SAFETY SOCKET HEAD

CROSS RELATED REFERENCE OF THE PRESENT INVENTION

This application is a regular application of a provisional application Ser. No. 60/080,394, filed Apr. 2, 1998.

FIELD OF THE PRESENT INVENTION

The present invention relates to electrical socket arrangement, and more particularly to a safety socket head integrally connected on a socket body, wherein the socket head can shelter the electrical components inside the socket body to prevent intrusion of any undesired substance other than the electrical plug, so as to eliminate the chance for children to get shock, the occurrence of electrical leakage, and the unwanted damage to the electrical system.

BACKGROUND OF THE PRESENT INVENTION

In the high technology world today, electrical product or equipment can be found in every home or working office. Each electrical product or equipment needs to have a wire plug for plugging into an electrical socket arrangement, so that electricity power supply can be transferred through the socket, the plug and the wire to the electrical product or equipment for properly function. The electrical socket arrangements become the essential parts of our daily necessity. They are so important that we can see them everywhere and have to utilize them any time.

As shown in FIG. 1, a conventional electrical socket arrangement 10 comprises a socket head 11 integrally connected above a socket body 12, in which all the electrical components are installed inside the socket body 12 and the socket head 11 has two socket slots 13 provided thereon to respectively guide the two plug prongs of a plug to insert therethrough and into the socket body 12, so that the two plug prongs are engaged with the copper made electrical conduction plates installed inside the socket body 12 (not shown in the drawings). Therefore, the electrical plug can be electrically connected with the electrical socket arrangement 10 through the plug prongs and the electrical conduction plates inside the socket body 12.

However, all of the conventional electrical socket arrangements have a common shortcoming, that is the interior electrical components inside the socket body 12 are exposed in open through the socket slots 13 of the socket head 11, so that undesired substances (such as metal sharp objects, moist, dust, and bugs) may easily enter the socket body 12 via the socket slots 13 of the socket head 11 and cause unreasonable hazard.

Normally, the conventional electrical socket arrangements 10 are installed on the wall at between half foot to one foot above the ground level for easy access. However, due to the fact that the interior electrical components of the socket body 12 are always exposed in open through the socket slots 13 of the socket head 11, therefore when an unknown substance other than the two plug prongs of the electrical plug is inserted into the socket slot(s) 13, the electrical system may be damaged and the electrical leakage may also occur. The hazard condition is more serious when there are young children in the household. Young children always have high curiosity to try different things. They might insert metal substances such as needles, screws or keys into the socket slots 13 of the electrical socket head 11 that may results in serious electrical shock.

SUMMARY OF THE PRESENT INVENTION

It is thus a first object of the present invention to provide a safety socket head for incorporating with a socket body to form a socket arrangement, wherein the safety socket head can shelter the socket body to prevent any undesired substance to insert through each socket slot provided on the socket housing, so as to eliminate the chance for the children to get shock, the occurrence of electrical leakage, and the possible damage to the electrical system.

A further object of the present invention is to provide a safety socket head covering on a socket body to form a socket arrangement, wherein the safety socket head only enables the electrical plug to plug in when the two plug prongs of an electrical plug are inserted into the two socket slots of the socket head simultaneously in order to ensure safety.

In order to accomplish the above objectives, the present invention provides a safety socket head for connecting with a socket body to form a socket arrangement, wherein the safety socket head comprises a socket housing which has a first and a second socket slot parallelly provided thereon, a first shelter means which is slidably supported inside the socket housing and positioned below the first socket slot for blocking the first socket slot during normal condition, a second shelter means which is slidably supported inside the socket housing and positioned below the second socket slot for blocking the second socket slot during normal condition, and a resilient means for retaining the first and the second shelter means in the normal condition so as to shelter any undesired substance to intrude into either the first socket slot or the second socket slot.

However, when two plug prongs of an electrical plug are inserted into the first and second socket slots simultaneously, the two plug prongs can drive both the first and the second shelter means to shift aside respectively to enable the two plug prongs to insert therethrough and into the socket body. Moreover, when the above plug-in condition is released, that is the electrical plug is detached from the socket head, the resilient means inside the socket head would respectively push the first and the second shelter means to slide back to their original position.

According to the present invention, the first shelter means, which is slidably disposed below the first and second socket slots, has a first blocking portion for blocking the first socket slot on the socket housing during normal condition and a first driving portion positioning right below the second socket slot. The first driving portion of the first shelter means forms a first passage groove which has an inclined first guiding edge positioning underneath the second socket slot and sheltering the second socket slot, in which when one of the plug prongs of the electrical plug is plugged in the second socket slot, the inserting plug plate would prop against the first guiding edge and drive the first shelter means to slide aside until the first blocking portion of the first shelter means is moved away from the first socket slot.

Similarly, the second shelter means is also slidably disposed below the first and second socket slots and overlapped with the first shelter means in an intercross manner. The second shelter means has a second blocking portion and a second driving portion extended from the second blocking portion. The second blocking portion is positioned under the first driving portion of the first shelter means for blocking the second socket slot on the socket housing during normal condition. The second driving portion, which is positioned above the first blocking portion of the first shelter means, forms a second passage groove which has an inclined second guiding edge positioning just underneath the first socket slot and sheltering the first socket slot. Therefore, when one of the plug prongs of the electrical plug is plugged in the first socket slot, the inserting plug plate would prop against the second guiding edge and drive the second shelter means to slide aside until the second blocking portion of the second shelter means is moved away from the second socket slot.

Accordingly, when the two plug prongs of the electrical plug are intruded through the first and second socket slots, both the first and the second shelter means are driven to slide aside until both the first and second blocking portions are moved away from the first and second socket slots respectively, so that the two plug prongs can successfully inserted through the socket head into the socket body. However, even when an undesired substance is intruded into the first socket slot to drive the second shelter means to slide aside, the intrusion of the undesired substance will be blocked by the first blocking portion of the first shelter means and the first guiding edge of the first driving portion of the first shelter means will still remain sheltering the second socket slot. Similarly, when only an undesired substance is intruded into the second socket slot to drive the first shelter means to slide aside, the intrusion of the undesired substance is blocked by the second blocking portion of the second shelter means and the second guiding edge of the second driving portion of the second shelter means still remains sheltering the first socket slot.

BRIEF DESCRIPTION OF THE DRAWINGS

FIG. 7 is another sectional end view of the safety socket head according to the above first preferred embodiment of the present invention, wherein an electrical plug is plugged in.

FIG. 16 is a sectional end view of the safety socket head according to the above second preferred embodiment of the present invention, wherein an electrical plug is plugged in.

DETAILED DESCRIPTION OF THE PREFERRED EMBODIMENTS

Figure 5B:
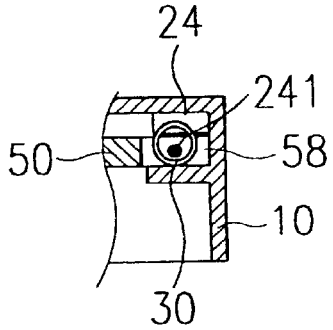
FIG. 5B is a partial sectional view, along section line E—E in FIG. 5A, of the safety socket head according to the above first preferred embodiment of the present invention.
Figure 5A:
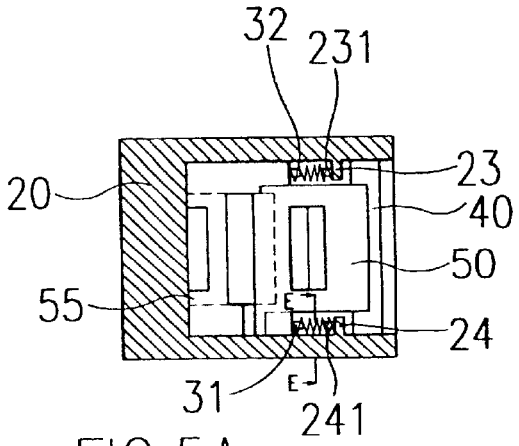
FIG. 5A is a sectional plan view, along section line A—A in FIG. 2, of the safety socket head according to the above first preferred embodiment of the present invention.
Figure 6:
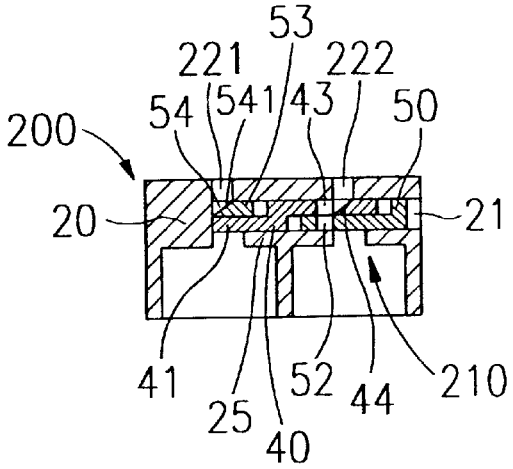
FIG. 6 is a sectional end view, along section line B—B in FIG. 2, of the safety socket head according to the above first preferred embodiment of the present invention.
Figure 7:
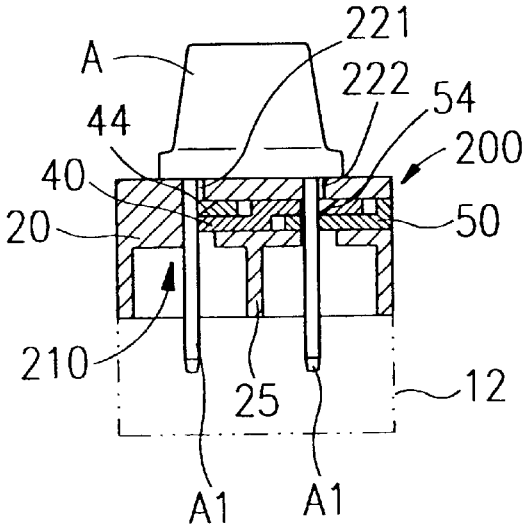
Figure 9:
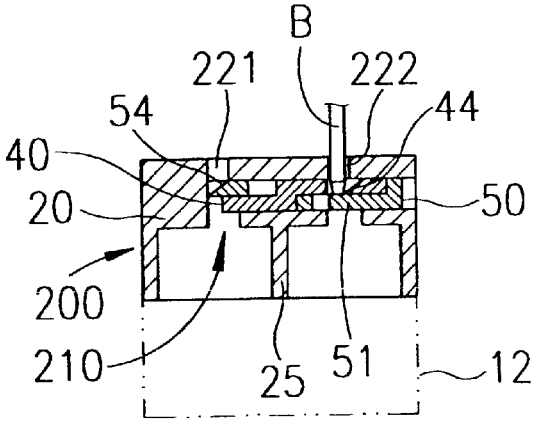
FIG. 9 is a sectional end view of the safety socket head according to the above first preferred embodiment of the present invention, wherein only an undesired substance is intruded into the second socket slot of the safety socket head.
Figure 8:
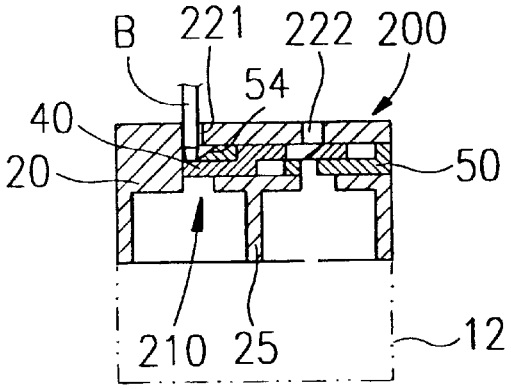
FIG. 8 is a sectional end view of the safety socket head according to the above first preferred embodiment of the present invention, wherein only an undesired substance is intruded into the first socket slot of the safety socket head.

Referring to FIGS. 2 to 9, a safety socket head 20 for connecting with a socket body 12 (as shown in FIGS. 7 to 9) to form a socket arrangement, wherein the safety socket head 200 comprises a socket housing 20 which has a first socket slot 221 and a second socket slot 222 parallelly provided thereon, a first shelter means 40, which is slidably supported inside the socket housing 20 and positioned below the first socket slot 221, for blocking the first socket slot 221 during normal condition, a second shelter means 50, which is slidably supported inside the socket housing 20 and positioned below the second socket slot 222, for blocking the second socket slot 222 during normal condition, and a resilient means 30 for retaining the first and the second shelter means 40, 50 in the normal condition so as to shelter any undesired substance to intrude into either the first socket slot 221 or the second socket slot 222. However, when two plug prongs A1 of an electrical plug A, as shown in FIG. 7, are inserted into the first and second socket slots 221, 222 simultaneously, the two plug prongs A1 can drive both the first and the second shelter means 40, 50 to shift aside respectively to enable the two plug prongs A1 to insert therethrough into the socket body 12. Moreover, when the above plug-in condition is released, that is the electrical plug A is detached from the socket head 200, the resilient means 30 inside the socket housing 20 would respectively push the first and the second shelter means 40, 50 to slide back to their original position.

According to a first preferred embodiment of the present invention, as shown in FIGS. 3 to 6, the first shelter means 40, which is slidably disposed below the first and second socket slots 221, 222 inside the socket housing 20, has a first blocking portion 41 for blocking the first socket slot 221 of the socket housing 20 during normal condition and a first driving portion 42 positioning right below the second socket slot 222. The first driving portion 42 of the first shelter means 40 is extended above the first blocking portion 41 and forms a passage groove 43 which has an inclined first guiding edge 44 positioning underneath and sheltering the second socket slot 222. So that when one of the plug prongs A1 of the electrical plug A is plugged in the second socket slot 222, as shown in FIGS. 7 and 9, the inserting plug prong A1 would prop against the first guiding edge 44 and drive the first shelter means 40 to slide aside until the first blocking portion 41 of the first shelter means 40 is moved away from the first socket slot 221, i.e. no more blocking the first socket slot 221.

The second shelter means 50 is also slidably disposed below the first and second socket slots 221, 222 inside the socket housing 20 and overlapped with the first shelter means 40 in an intercross manner. The second shelter means 50 has a second blocking portion 51 and a second driving portion 53 extended from the second blocking portion 51. The second blocking portion 51 is positioned under the first driving portion 42 of the first shelter means 40 for blocking the second socket slot 222 of the socket housing 20 during normal condition. The second driving portion 53, which is positioned above the first blocking portion 41 of the first shelter means 40, provides a second passage groove 54 which has an inclined second guiding edge 541 positioning just underneath the first socket slot 221 and sheltering the first socket slot 221. Therefore, when one of the plug plates A1 of the electrical plug A is plugged in the first socket slot 221, as shown in FIGS. 7 and 8, the inserting plug prong A1 would prop against the second guiding edge 54 and drive the second shelter means 50 to slide aside until the second blocking portion 51 of the second shelter means 50 is moved away from the second socket slot 222, i.e. no more blocking the second socket slot 222.

Accordingly, when the two plug prongs A1 of the electrical plug A are intruded through the first and second socket slots 221, 222, both the first and the second shelter means 40, 50 are driven to slide aside until both the first and second blocking portions 41, 51 are moved away from the first and second socket slots 221, 222 respectively, so that the two plug prongs A1 can successfully inserted through the socket head 200 into the socket body 12. However, even when an undesired substance is intruded into the first socket slot 221 to drive the second shelter means 50 to slide aside, the intrusion of the undesired substance will be blocked by the first blocking portion 41 of the first shelter means 40 and the first guiding edge 44 of the first driving portion 42 of the first shelter means 40 will still remain sheltering the second socket slot 222. Similarly, when only an undesired substance is intruded into the second socket slot 222 to drive the first shelter means 40 to slide aside, the intrusion of the undesired substance is blocked by the second blocking portion 53 of the second shelter means 50 and the second guiding edge 541 of the second driving portion 53 of the second shelter means 50 still remains sheltering the first socket slot 221.

Figure 1:
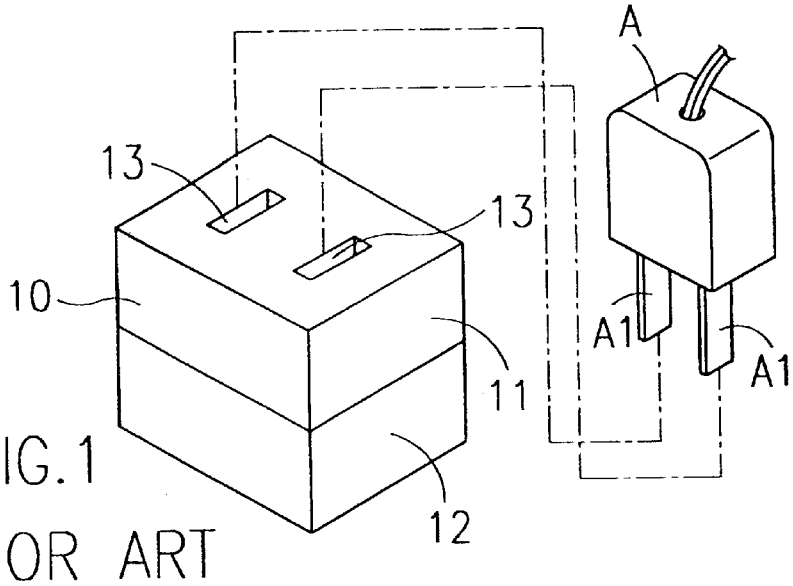
FIG. 1 PRIOR ART
FIG. 1 is a perspective view of a conventional electrical socket arrangement which has a socket head connected on top of a socket body.
Figure 2:
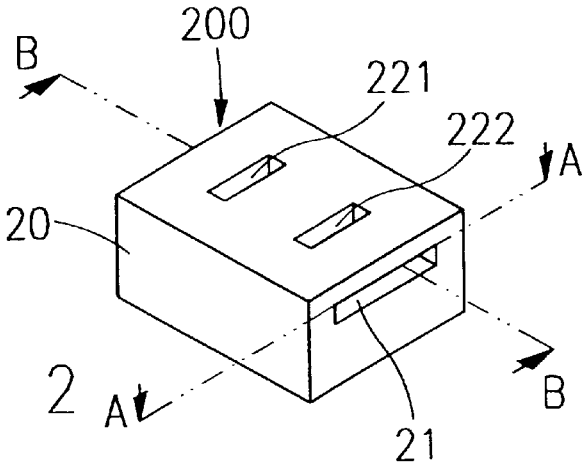
FIG. 2 is a perspective view of a safety socket head according to a first preferred embodiment of the present invention.
Figure 3:
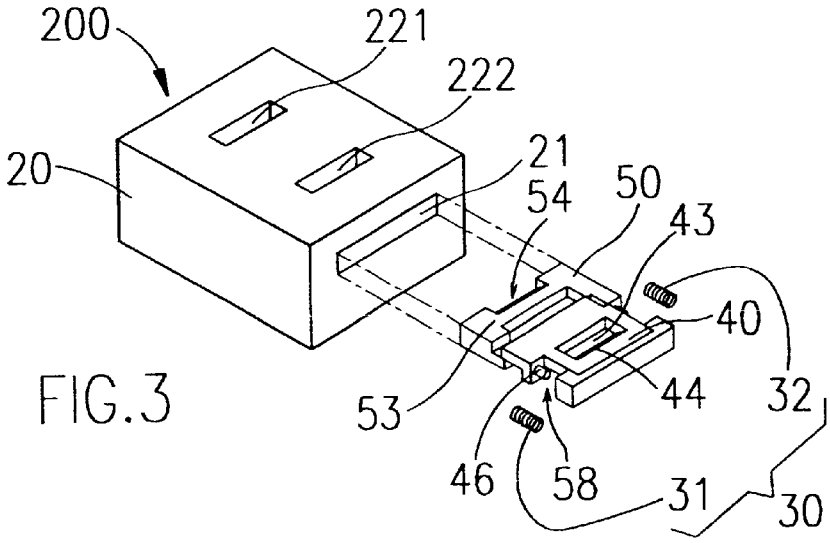
FIG. 3 is a partial exploded perspective view of the safety socket head according to the above first preferred embodiment of the present invention.

Referring to FIGS. 2 to 7 of the drawings, the safety socket head 200 according to the first preferred embodiment of the present invention is disclosed in detail. The improved safety socket head 200 is capable of preventing unknown or undesired substances from entering the socket head 200. As shown in FIGS. 2 and 3, the socket housing 20 is a rectangular shaped box which has a bottom opening communicated with the socket body 12, wherein on a shorter side of the socket head 200 provides an inlet opening 21 for allowing the first shelter means 40 and the second shelter means 50 to insert into an interior chamber 210 of the socket housing 20. The two parallel socket slot 221, 222 are formed on a top surface of the socket housing 20 for the two plug prongs A1 of the contact plug A to insert therethrough.

As shown in FIGS. 5A, 5B and 6, inside the interior chamber 210, the socket housing 20 further provides a left protruding rib 23 protruded from a side wall, a right protruding rib 24 protruded from another opposing side wall, and a middle supporting rib 25 extended along the interior chamber 210 to support the first and second shelter means 40, 50. The left protruding rib 23 and the right protruding rib 24 are formed near the inlet opening 21 and each further inwardly protrudes a bearing rod 231, 241.

Figure 4A:
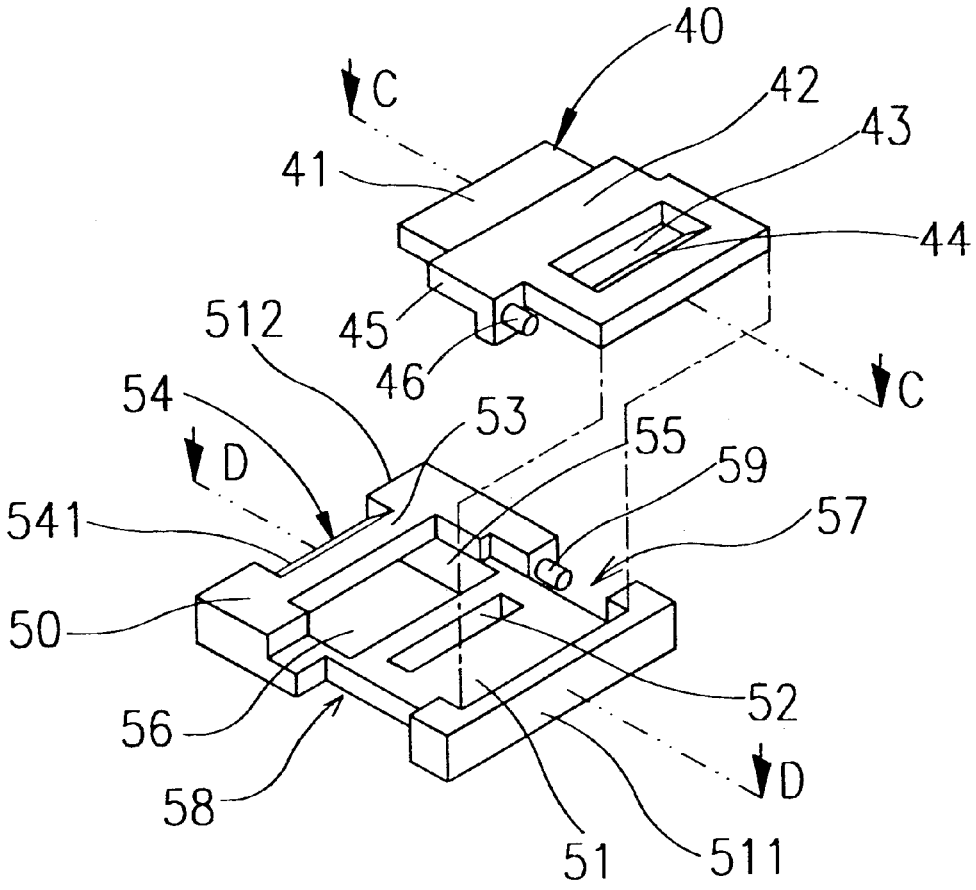
FIG. 4A is an exploded perspective view illustrating the first and the second shelter means according to the above first preferred embodiment of the present invention.

The first shelter means 40 has a cross section in a step-up shaped, wherein the first blocking portion 41 is integrally connected to a bottom end of the first driving portion 42. The first driving portion 42 is in flat rectangular shape (as shown in FIG. 4A) and transversely provides a rectangular guide hole 43 thereon adapted for the plug prong A1 of the contact plug A to insert therethrough. An outer side of the guide hole 43 is in sloped shape to form the inclined first guiding edge 44 for guiding the plug prong A1 to insert into the guide hole 43 while the inserting plug prong A1 pushes the first shelter means 40 to move towards the inlet opening 21. A L-shaped shoulder 45 is extended from a longitudinal side of the first shelter means 40, which has a first supporting rod 46 protruding therefrom and opposing the right bearing rod 24.

Figure 4C:
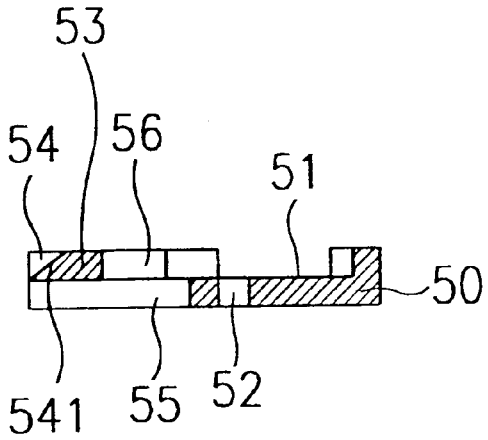
FIG. 4C is a sectional view, along section line D–D in FIG. 4A, of the second shelter means according to the above first preferred embodiment of the present invention.
Figure 4B:
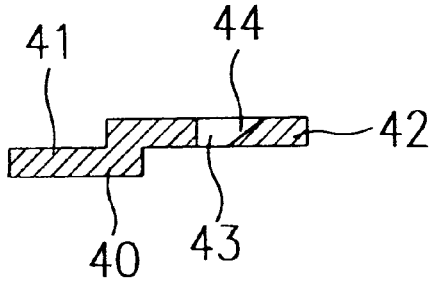
FIG. 4B is a sectional view, along section line C—C in FIG. 4A, of the first shelter means according to the above first preferred embodiment of the present invention.

The second shelter means 50 is also in a flat rectangular shape (as shown in FIG. 4). The second blocking portion 51 is an indented portion 51 formed near a front end 511 on a top surface of the second shelter means 50. The second blocking portion 51 has a rectangular plug hole 52 provided thereon for enabling the plug prong A1 of the contact plug A to insert therethrough. The second driving portion 53 is formed near a rear end 512 of the second shelter means 50. The second passage groove 54 is provided on the second driving portion 53 and forms the inclined second guiding edge 541 to guide the insertion of the plug prong A1. The second shelter means 50 further has a middle frame 55 connecting the second blocking portion 51 with the second driving portion 53. The middle frame 55 has a passage hole 56 provided between the second blocking portion 51 and the second driving portion 53 so that the first shelter means 40 can be overlapped with the second shelter means 50 in an intercross manner. In which, the first driving portion 42 of the first shelter means 40 is positioned on the second blocking portion 51 of the second shelter means 50 while the first blocking portion 42 of first shelter means 40 penetrates through the passage hole 56 and positioned below the second driving portion 53 of the second shelter means 50. Two side indenting grooves 57, 58 are formed on two longitudinal sides of the second shelter means 50 respectively, wherein the right and left protruding ribs 23, 24 are respectively positioned within the two indenting grooves 57, 58 respectively when the second shelter means 50 is slidably sit inside the interior chamber 210 of the socket housing 20. At a rear end of the indenting grooves 57, a second supporting rod 59 is protruded towards the left bearing rod 231 of the left protruding rib 23.

According to the first preferred embodiment, as shown in FIGS. 3, 5A and 5B, the resilient means 30 comprises a first and a second compression spring 31, 32, wherein the first compression spring 31 is mounted between the right bearing rod 241 and the first supporting rod 46 of the first shelter means 40 for retaining the first shelter means 40 in the normal condition, and that the second compression spring 32 is mounted between the left bearing rod 231 and the second supporting rod 46 of the second shelter means 50 for retaining the second shelter means 40 in the normal condition.

Referring to FIGS. 2 to 8 of the drawings, to assemble the safety socket head 200, the first shelter means 40 has to combine with the second shelter means 50, in which the first blocking portion 41 of the first shelter means 40 is penetrated through the passage hole 56 of the second shelter means 50 until the first driving portion 42 of the first shelter means 40 is positioned on the second blocking portion 51 of the second shelter means 50, wherein the first bearing rod 46 of the first shelter means 40 is positioned within the right indenting groove 58 of the second shelter means 50 (as shown in FIG. 3).

The combined first shelter means 40 and the second shelter means 50 is then inserted into the interior chamber 210 of the socket housing 20 through the inlet opening 21 and rest on the middle supporting rib 25 (as shown in FIG. 6) while the front end 511 of the second shelter means 50 is facing the inlet opening 21 of the socket housing 20. Then, turn the whole socket head 20 upside down and mount the first compression spring 31 between by the first supporting rod 46 of the first shelter means 40 and the right bearing rod 24 respectively (as shown in FIG. 5A) and the second compression spring 32 between the second supporting rod 59 of the second shelter means 50 and the left bearing rod 231 respectively.

As shown in FIG. 6, under a normal condition (i.e. no plug prong A1 is inserted into both the socket slots 221, 222), the guide hole 43 of the first shelter means 40 is aligned with the plug hole 52 of the second shelter means 50, wherein a distance between the first guiding edge 44 of the first shelter means 40 and the second guiding edge 541 is equal to a distance between two socket slots 221, 222. In other words, the first and the second guiding edge 44, 541 are respectively positioned right underneath the two socket slots 221, 222, however the guide hole 43 is just positioned adjacent the second socket slot 222 and the plug hole 52 is coaxially aligned below the guide hole 43. At this moment, the first blocking portion 41 of the first shelter means 40 is positioned below the first socket slot 221.

As shown in FIG. 7, when the two plug prongs A1 of the contact plug A are inserted into the first and second socket slots 221, 222 simultaneously, the two plug prongs A1 will respectively prop against the first guiding edge 44 of the first shelter means 40 and the second guiding edge 54 of the second shelter means 50. The downward plugging force of the two plug prongs A1 will simultaneously push the first shelter means 40 and the second shelter means 50 to move towards the inlet opening 21, and that the two compression springs 31, 32 are both being compressed to build up a rebounding force. Therefore, the two inserting plug prongs A1 can successfully insert through the interior chamber 210 of the socket housing 20 into the socket body 12 to electrically connect with the electrical terminals in the socket body, wherein the plug prong A1 which plugs through the second socket slot 222 penetrates through the plug hole 52 of the blocking portion 51 of the second shelter means 50 and the plug prong A1 which plugs through the first socket slot 221 is by-passing the blocking portion 41 of the first shelter means 40.

When the plug prongs A1 are detached from the socket head 200, the first shelter means 40 and the second shelter means 50 would be returned to the original position due to the rebounding force released by the two compression springs 31, 32, as shown in FIGS. 6 and 7.

When people use a single sharp object B to intrude into the first socket slot 221 of the socket head 20, as shown in FIG. 8, although the sharp object B will contact the second guiding edge 54 of the second shelter means 50, the sharp object B is blocked by the first blocking portion 41 of the first shelter means 40, so that the sharp object B is unable to further insert into the interior chamber 210 of the socket head 200. Similarly, when people use a single sharp object B to intrude into the second socket slot 222 of the socket head 20, as shown in FIG. 9, the sharp object B will contact the first guiding edge 44 of the first shelter means 40 and be blocked by the second blocking portion 51 of the second shelter means 50, so that the sharp object B is unable to further insert into the interior chamber 210 of the socket head 200.

Figure 10:
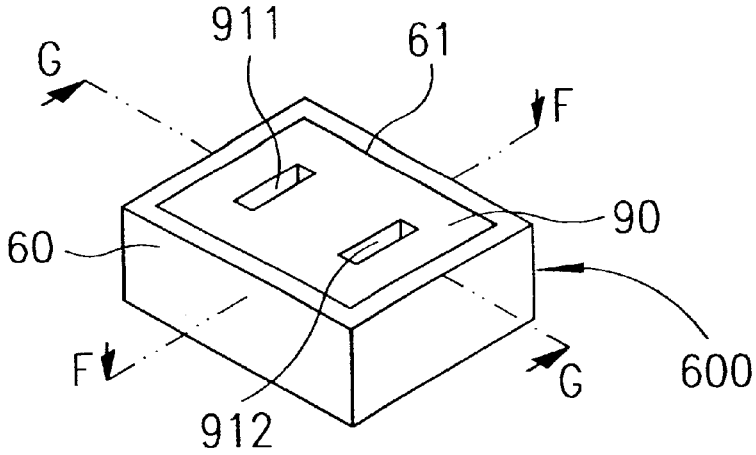
FIG. 10 is a perspective view of a safety socket head according to a second preferred embodiment of the present invention.
Figure 11:
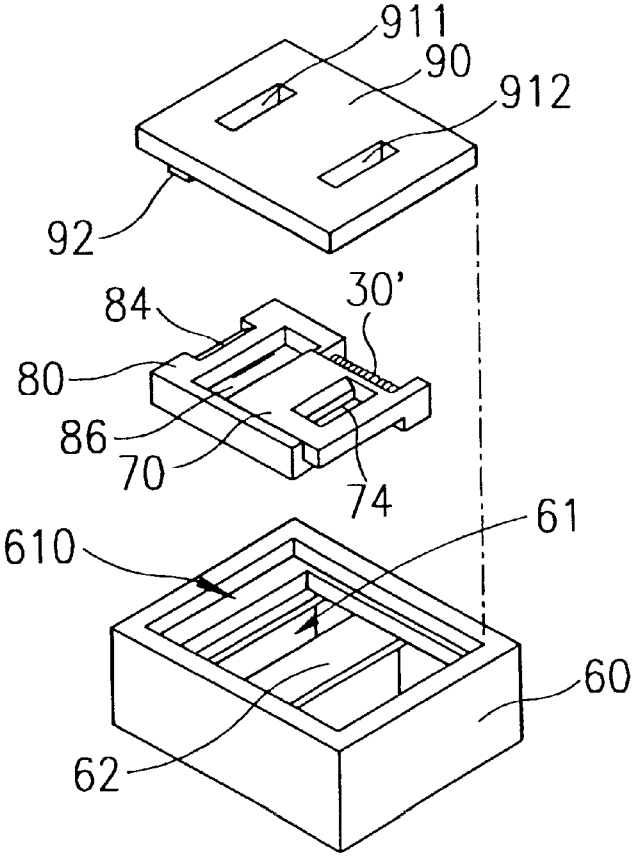
FIG. 11 is an exploded perspective view of the safety socket head according to the above second preferred embodiment of the present invention.
Figure 12A:
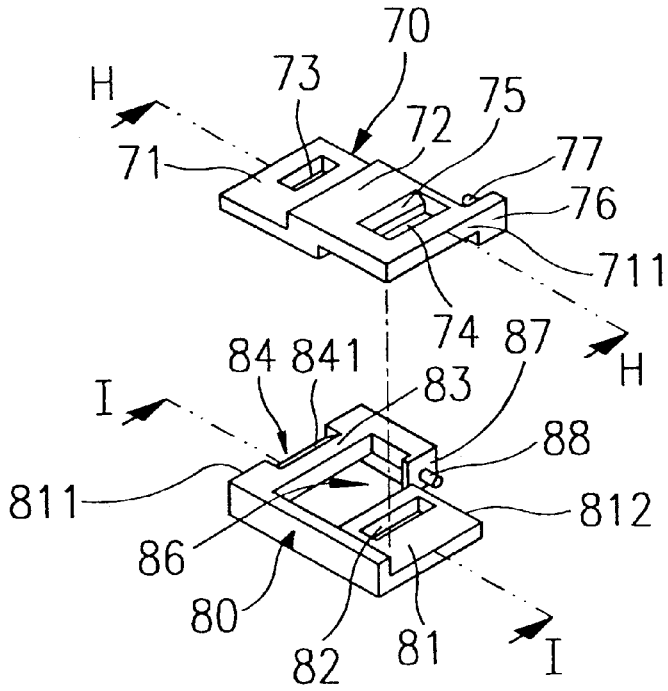
FIG. 12A is an exploded perspective view illustrating the first and the second shelter means according to the above second preferred embodiment of the present invention.
Figure 12C:
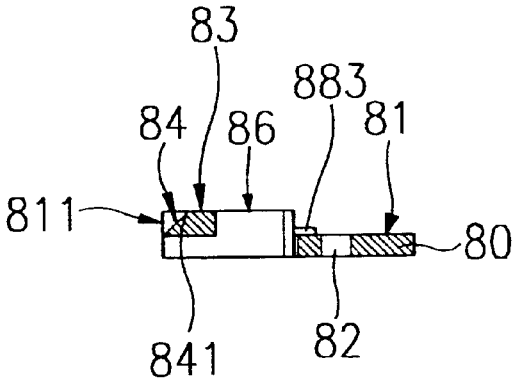
FIG. 12C is a sectional view, along section line I—I in FIG. 12A, of the second shelter means according to the above second preferred embodiment of the present invention.
Figure 12B:
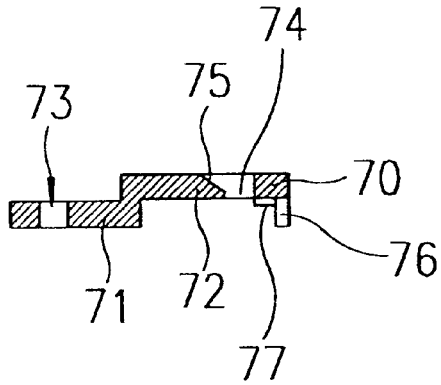
FIG. 12B is a sectional view, along section line H—H in FIG. 12A, of the first shelter means according to the above second preferred embodiment of the present invention.
Figure 13:
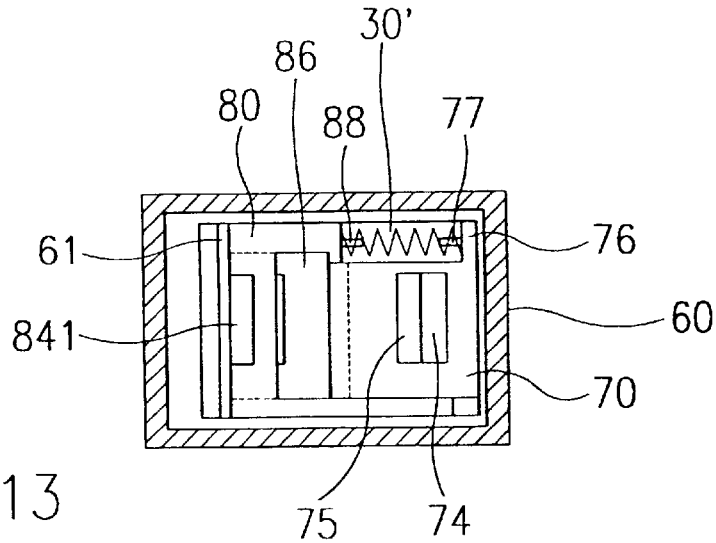
FIG. 13 is a sectional plan view, along section line F—F in FIG. 10, of the safety socket head according to the above second preferred embodiment of the present invention.
Figure 14:
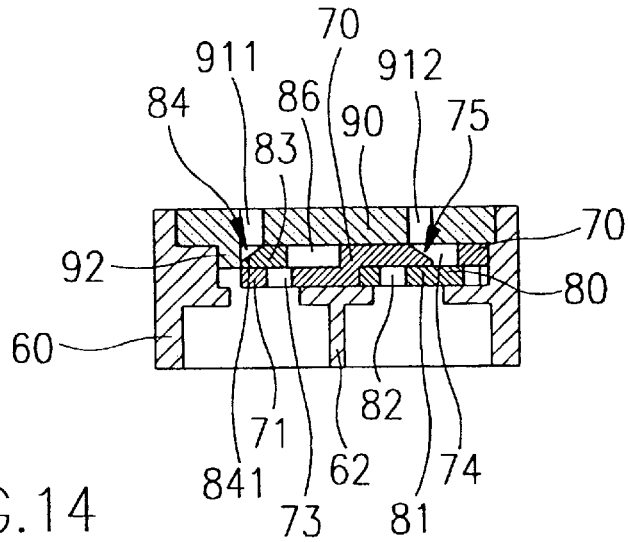
FIG. 14 is a sectional end view, along section line G—G in FIG. 10, of the safety socket head according to the above second preferred embodiment of the present invention.
Figure 15:
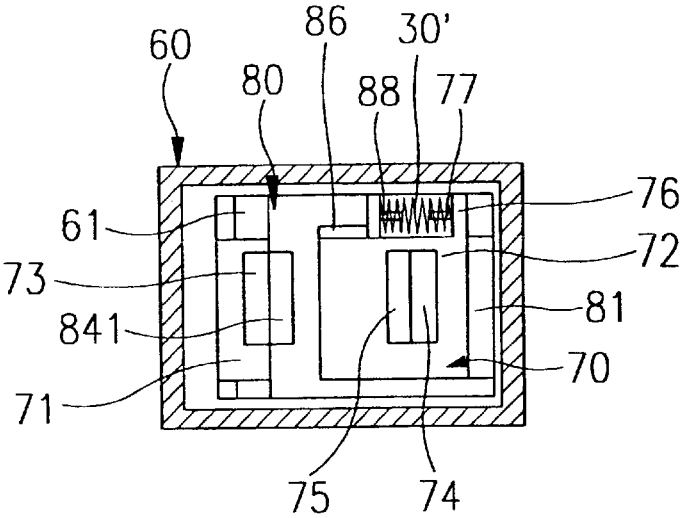
FIG. 15 is a sectional plan view of the safety socket head according to the above second preferred embodiment, wherein the first and second shelter means are pressed towards each other.

Referring to FIGS. 10 to 14 of the drawings, a safety socket head 600 according to a second preferred embodiment of the present invention is illustrated. The safety socket head 600 also comprises a socket housing 60 in a rectangular box shape, a first shelter means 70, a second shelter means 80 for combining with the first shelter means 70, and a resilient means 30'. The socket housing 60 has a top opening 610 and an interior chamber 61 for allowing the combined first shelter means 70 and the second shelter means 80 to disposed therein. The socket housing 60 further comprises a top lid 90 to cover the interior chamber 61, as shown in FIGS. 10 and 11. A middle supporting rib 62 is extended in a middle position inside the interior chamber 61 to enable the first and second shelter means 70, 80 to slidably rest thereon, as shown in FIG. 14.

Figure 16:
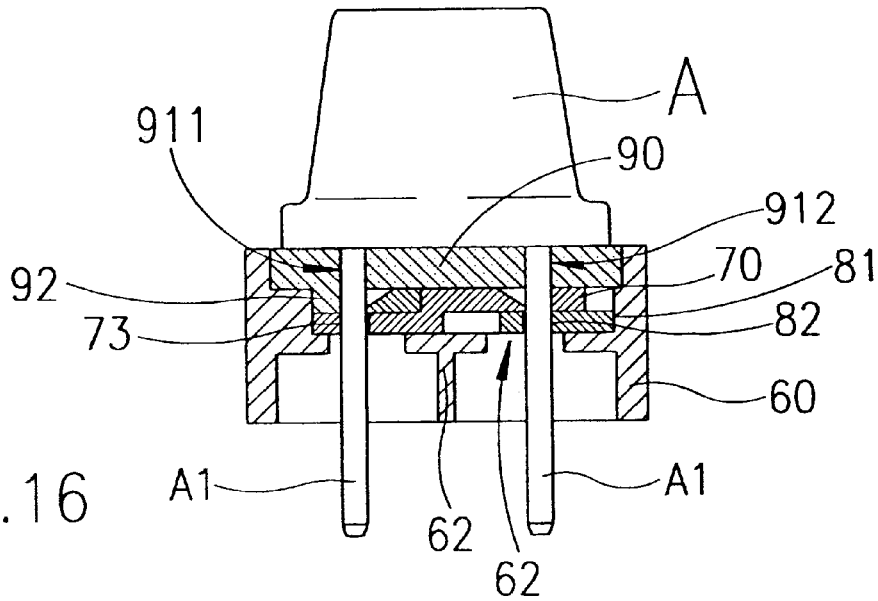

The top lid 90 parallelly provides a first and a socket slot 911, 912 for two plug prongs A1 of an electrical plug A to insert therethrough, as shown in FIG. 16. The top lid 90 further comprises a protruding rib 92 extended downwardly therefrom near the first socket slot 911.

As shown in FIGS. 11, 12A and 12B, the first shelter means 70 which has a cross section in a step-up shaped, has a first blocking portion 71 and a first driving portion 72 extended in a higher plane from the first blocking portion 71, wherein the first blocking portion 71 has a first plug hole 73 transversely provided thereon and the first driving portion 72 provides a guide hole 74 that enable the plug prongs A1 of the contact plug A to insert therein. An inner side of the guide hole 74 is in a sloped shape to form an inclined first guiding edge 75 for guiding the insertion of the plug prong A1 to enter the guide hole 74. The first driving portion 72 of the first shelter means 70 sidewardly protruded a first supporting shoulder 76 which has a first bearing rod 77 extended rearwardly.

As shown in FIGS. 11, 12A and 12C, the second shelter means 80 which is in a flat rectangular shape has a second blocking portion 81 and a second driving portion 83. The second blocking portion has a second plug hole 82 provided thereon for enabling the plug prong A1 of the electrical plug A to insert therethrough. A rear end 811 of the second shelter means 80 provides a second passage groove 84 which has an inclined surface to form a second guiding edge 841 for guiding the plug prong A1 to enter the interior chamber 61 of the socket housing 60. The second shelter means 50 further has a passage hole 86 formed between the second blocking portion 81 and the second driving portion 83 to enable the first shelter means 70 penetrating therethrough. The second driving portion 83 of the second shelter means 80 sidewardly protruded a second supporting shoulder 87 which has a second bearing rod 88 extended frontwardly.

The resilient means 30' comprises a compression spring mounted between the first bearing rod 77 and the second bearing rod 88 for retaining the first and second shelter means 70, 80 in a normal condition.

Referring to FIGS. 10 to 14 of the drawings, to assemble the safety socket head 600, the first shelter means 70 and the second shelter means 80 of the present invention has to combine by first penetrating the first blocking portion 71 of the first shelter means 70 through the passage hole 86 of the second shelter means 80, and then positioning the first driving portion 72 of the first shelter means 70 on top of the second blocking portion 81 of the second shelter means 80, wherein the first bearing rod 77 of the first shelter means 70 is aligned in straight line manner with respect to the second bearing rod 88 of the second shelter means 80. Thus, the compression spring 30 is compressed between the first and second bearing rods 77, 88, as shown in FIG. 13.

The combined first shelter means 70 and second shelter means 80 are then positioned within the socket housing 60 through the top opening 610 and rested on the supporting rib 62. The top lid 90 is then covered on the open opening 610 of the socket housing 60 and sealed by a supersonic wave to integrally unit the top surface of the socket housing 60 and the top lid 90, as shown in FIG. 10.

As shown in FIG. 14, during the normal condition, the first guiding edge 75 and the second guiding edge 84 are respectively aligned underneath the second socket slot 912 and the first socket slot 911, wherein a distance between the first guiding edge 75 of the first shelter means 70 and the second guiding edge 84 is equal to a distance between two plug socket holes 911, 912. In which, the first blocking portion 71 of the first shelter means 70 is positioned below the second driving portion 83 of the second shelter means 80 with the first plug hole 73 located adjacent to the first socket slot 911, and that the second blocking portion 83 of the second shelter means 80 is positioned below the first driving portion 72 of the first shelter means 70 with the second plug hole 82 located adjacent to the second socket slot 912.

Therefore, as shown in FIG. 16, when the two plug prongs A1 of the electrical plug A are plugged in the first and the second socket slot 911, 912 of the top lid 90 respectively, the two plug prongs A1 are respectively propped against the first guiding edge 75 of the first shelter means 70 and the second guiding edge 84 of the second shelter means 80 and simultaneously push both the first shelter means 70 and the second shelter means 80 to slide toward a center of the socket housing 60, so that the two plug prongs A1 are able to penetrate the first and second plug holes 73, 82 and further enter the interior chamber 61 of the socket housing 60. After the two plug prongs A1 are fully inserted into the interior chamber 61 of the socket housing 60, the compression spring 30' is compressed to build up a rebounding force.

Thus, when the two plug prongs A1 are detached from the socket head 600, the first shelter means 70 and the second shelter means 80 would return to their original position due to the rebounding force released by the compression springs 30, as shown in FIG. 14.

Figure 17:
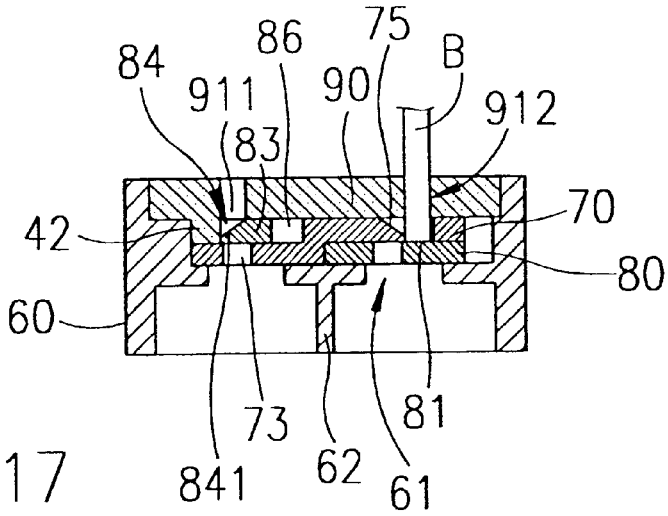
FIG. 17 is a sectional end view of the safety socket head according to the above second preferred embodiment of the present invention, wherein only an undesired substance is intruded into the second socket slot of the safety socket head.

Referring to FIG. 17, when people use a single sharp object B to intrude the second socket slot 912, the sharp object B will contact the first guiding edge 75 of the first shelter means 70 and be blocked by the second blocking portion 81 of the second shelter means 80, so that the sharp object B is unable to further insert into the interior chamber 61 of the socket housing 60.

Figure 18:
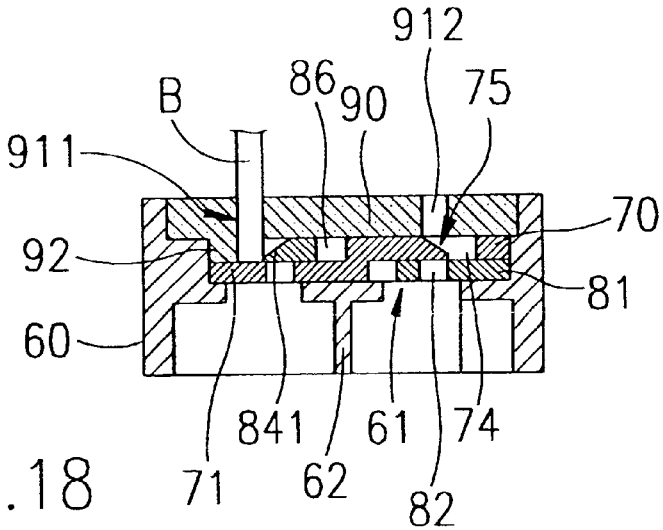
FIG. 18 is a sectional end view of the safety socket head according to the above second preferred embodiment of the present invention, wherein only an undesired substance is intruded into the first socket slot of the safety socket head.

Referring to FIG. 18, when people use the single sharp object B to intrude the first socket slot 911, the sharp object B will contact the second guiding edge 841 of the second shelter means 80, but sharp object is blocked by the first blocking portion 71 of the first shelter means 70, so that the sharp object B is unable to further insert into the interior chamber 61 of the socket housing 60.

Accordingly, the socket head as disclosed in the present invention is substantially a safe guard against unknown or undesired substance from entering. The present invention can also prevent damage to the socket head and electrical shock for those curious children whom insert metal object into the socket head of the socket arrangement.

What is claimed is:

1. A safety socket head for connecting with a socket body to form a socket arrangement for electrically coupling with an electrical plug having at least two plug prongs, comprising:

a socket housing which has a first socket slot and a second socket slot parallelly provided thereon, a first shelter means, which is slidably supported inside said socket housing and positioned below said first socket slot, for blocking said first socket slot during a normal condition, a second shelter means, which is slidably supported inside said socket housing and positioned below said second socket slot, for blocking said second socket slot during said normal condition, and a resilient means for retaining said first and said second shelter means in said normal condition so as to shelter any undesired substance to intrude into either said first socket slot or said second socket slot, however when said two plug prongs of said electrical plug are inserted into said first and second socket slots simultaneously, said two plug prongs drive both said first and said second shelter means to slide aside respectively to enable said two plug prongs to insert therethrough into said socket body, moreover when said two plug prongs are detached from said safety socket head, said resilient means inside said socket housing respectively pushing said first and said second shelter means to slide back to said normal condition, wherein said first shelter means, which is slidably disposed below said first and second socket slots inside said socket housing, has a first blocking portion for blocking said first socket slot of said socket housing during said normal condition and a first driving portion positioning right below said second socket slot, said first driving portion of said first shelter means being extended above said first blocking portion and forming a passage groove which has an inclined first guiding edge positioning underneath and sheltering said second socket slot, so that when one of said plug prongs of said electrical plug is plugged in said second socket slot, said inserting plug prong props against said first guiding edge and drives said first shelter means to slide aside until said first blocking portion of said first shelter means is moved away from said first socket slot and does not block said first socket slot, wherein said second shelter means is also slidably disposed below said first and second socket slots inside said socket housing and overlapped with said first shelter means, said second shelter means having a second blocking portion and a second driving portion extended from said second blocking portion, said second blocking portion being positioned under said first driving portion of said first shelter means for blocking said second socket slot of said socket housing during said normal condition, said second driving portion, which is positioned above said first blocking portion of said first shelter means, providing a second passage groove which has an inclined second guiding edge positioning just underneath said first socket slot and sheltering said first socket slot, therefore when one of said plug prongs of said electrical plug is plugged in said first socket slot, said inserting plug prong props against said second guiding edge and drives said second shelter means to slide aside until said second blocking portion of said second shelter means is moved away from said second socket slot and does not block said second socket slot, so that when said two plug prongs of said electrical plug are intruded through said first and second socket slots respectively, both said first and said second shelter means are driven to slide aside until both said first and second blocking portions are moved away from said first and second socket slots respectively, therefore said two plug prongs are able to successfully insert through said socket head into said socket body, however when an undesired substance is intruded into said first socket slot to drive said second shelter means to slide aside, said intrusion of said undesired substance is blocked by said first blocking portion of said first shelter means and said second socket slot is sheltered by said first guiding edge of said first driving portion of said first shelter means, moreover when said undesired substance is only intruded into said second socket slot to drive said first shelter means to slide aside, said intrusion of said undesired substance is blocked by said second blocking portion of said second shelter means and said first socket slot is sheltered by said second guiding edge of said second driving portion of said second shelter means.

2. A safety socket head, as recited in claim 1, wherein said socket housing comprises a rectangular shaped box which has a bottom opening communicated with said socket body, wherein an inlet opening is provided on a shorter side of said socket head for allowing said first shelter means and said second shelter means to insert into an interior chamber of said socket housing, and that said two parallel socket slots are formed on a top surface of said socket housing.

3. A safety socket head, as recited in claim 2, wherein inside said interior chamber, said socket housing further provides a left protruding rib protruded from a side wall, a right protruding rib protruded from another opposing side wall, and a middle supporting rib extended along said interior chamber to support said first and second shelter means, and that said left protruding rib and said right protruding rib are formed near said inlet opening and each of said left protruding rib and said right protruding rib further inwardly protrudes a bearing rod.

4. A safety socket head, as recited in claim 3, wherein said first shelter means has a step-up shaped cross section that said first blocking portion is integrally connected to a bottom end of said first driving portion, and said first driving portion is in flat rectangular shape and transversely provides a rectangular guide hole thereon adapted for said plug prong to insert therethrough, an outer side of said guide hole being in sloped shape to form said inclined first guiding edge for guiding said plug prong to insert into said guide hole while said inserting plug prong pushes said first shelter means to move towards said inlet opening, a L-shaped shoulder being extended from a longitudinal side of said first shelter means, which has a first supporting rod protruding therefrom and opposing said right bearing rod.

5. A safety socket head, as recited in claim 4, wherein said second shelter means is in a flat rectangular shape that said second blocking portion is an indented portion formed near a front end on a top surface of said second shelter means and said second blocking portion has a rectangular plug hole provided thereon for enabling said plug prong to insert therethrough, said second driving portion being formed near a rear end of said second shelter means, said second passage groove is provided on said second driving portion and forms said inclined second guiding edge to guide said insertion of said plug prong, wherein said second shelter means further has a middle frame connecting said second blocking portion with said second driving portion, wherein said middle frame has a passage hole provided between said second blocking portion and said second driving portion so that said first shelter means is overlapped with said second shelter means, that said first driving portion of said first shelter means is positioned on said second blocking portion of said second shelter means while said first blocking portion of first shelter means penetrates through said passage hole and is positioned below said second driving portion of said second shelter means, moreover two side indenting grooves are formed on two longitudinal sides of said second shelter means respectively, wherein said right and left protruding ribs are respectively positioned within said two side indenting grooves respectively when said second shelter means is slidably sit inside said interior chamber of said socket housing, and that at a rear end of each of said side indenting grooves, a second supporting rod is protruded towards said left bearing rod of said left protruding rib.

6. A safety socket head, as recited in claim 5, wherein said resilient means comprises a first compression spring and a second compression spring, wherein said first compression spring is mounted between said right bearing rod and said first supporting rod of said first shelter means for retaining said first shelter means in said normal condition, and said second compression spring is mounted between said left bearing rod and said second supporting rod of said second shelter means for retaining said second shelter means in said normal condition.

7. A safety socket head, as recited in claim 1, wherein said socket housing has a top opening and an interior chamber for allowing said first shelter means and said second shelter means to disposed therein, said socket housing further comprising a top lid to cover said interior chamber, a middle supporting rib being extended in a middle position inside said interior chamber to enable said first and second shelter means being slidably supported thereon, wherein said first and second socket slots are provided on said top lip.

8. A safety socket head, as recited in claim 7, wherein said first shelter means has a step-up shaped cross section and said first driving portion is extended in a higher plane from said first blocking portion, wherein said first blocking portion has a first plug hole transversely provided thereon and said first driving portion provides a guide hole that enables said plug prongs to insert therein, an inner side of said guide hole being in a sloped shape to form said inclined first guiding edge for guiding said insertion of said plug prong to enter said guide hole, said first driving portion of said first shelter means sidewardly protruding a first supporting shoulder which has a first bearing rod extended rearwardly.

9. A safety socket head, as recited in claim 8, wherein said second shelter means is in a flat rectangular shape and said second blocking portion has a second plug hole provided thereon for enabling said plug prong of said electrical plug to insert therethrough, a rear end of said second shelter means providing a second passage groove which has an inclined surface to form said second guiding edge for guiding said plug prong to enter said interior chamber of said socket housing, said second shelter means further having a passage hole formed between said second blocking portion and said second driving portion to enable said first shelter means penetrating therethrough, said second driving portion of said second shelter means sidewardly protruding a second supporting shoulder which has a second bearing rod extended frontwardly.

10. A safety socket head, as recited in claim 9, wherein said resilient means comprises a compression spring mounted between said first bearing rod and said second bearing rod for retaining said first shelter means and said second shelter means in said normal condition.

11. A safety socket head, as recited in claim 1, wherein said first shelter means has a step-up shaped cross section and said first driving portion is extended in a higher plane from said first blocking portion, wherein said first blocking portion has a first plug hole transversely provided thereon and said first driving portion provides a guide hole that enables said plug prongs to insert therein, an inner side of said guide hole being in a sloped shape to form said inclined first guiding edge for guiding said insertion of said plug prong to enter said guide hole, said first driving portion of said first shelter means sidewardly protruding a first supporting shoulder which has a first bearing rod extended rearwardly.

12. A safety socket head, as recited in claim 11, wherein said second shelter means is in a flat rectangular shape and said second blocking portion has a second plug hole provided thereon for enabling said plug prong of said electrical plug to insert therethrough, a rear end of said second shelter means providing a second passage groove which has an inclined surface to form said second guiding edge for guiding said plug prong to enter said socket housing, said second shelter means further having a passage hole formed between said second blocking portion and said second driving portion to enable said first shelter means penetrating therethrough, said second driving portion of said second shelter means sidewardly protruding a second supporting shoulder which has a second bearing rod extended frontwardly.

13. A safety socket head, as recited in claim 12, wherein said resilient means comprises a compression spring mounted between said first bearing rod and said second bearing rod for retaining said first shelter means and said second shelter means in said normal condition.

* * * * *